United States Patent [19]

Martin

[11] Patent Number: 4,555,998

[45] Date of Patent: Dec. 3, 1985

[54] SEWING MACHINE FEED MECHANISM

[75] Inventor: August Martin, Morbach, Fed. Rep. of Germany

[73] Assignee: Pfaff Industriemaschinen GmbH, Fed. Rep. of Germany

[21] Appl. No.: 706,023

[22] Filed: Feb. 27, 1985

[30] Foreign Application Priority Data

Feb. 29, 1984 [DE] Fed. Rep. of Germany ..... 3407338

[51] Int. Cl.[4] ..... D05B 21/00; D05B 27/00

[52] U.S. Cl. ..... 112/121.12; 112/104; 112/308

[58] Field of Search ..... 112/121.12, 121.15, 112/121.11, 158 R, 308, 309, 104, 102, 113

[56] References Cited

U.S. PATENT DOCUMENTS

| | | | |
|---|---|---|---|
| 3,742,879 | 7/1973 | Schaefer, Jr. et al. | 112/121.12 |
| 3,974,787 | 8/1976 | Kraatz et al. | 112/121.12 |
| 3,983,825 | 10/1976 | Dobner et al. | 112/121.12 |
| 4,002,129 | 1/1977 | Kraatz | 112/121.15 |
| 4,419,946 | 12/1983 | Fischer et al. | 112/121.12 |
| 4,455,956 | 6/1984 | Yamamoto et al. | 112/121.12 X |

*Primary Examiner*—H. Hampton Hunter

*Attorney, Agent, or Firm*—McGlew and Tuttle

[57] ABSTRACT

A sewing assembly equipped with a feed mechanism comprises a work holder which is supported by two swing arms hinged to each other, and moved by two stationary positioning motors. Each of the positioning motors is in positive drive connection with a slide carrying one of the swing arms. The swing arm directly carrying the work holder comprises a non-buckling center bar, a cross bar, and two prestressed spring steel strips by which the ends of the cross bar are connected to the end close to the swing axis of the center bar. The two member linkage with the stationary motors and the light-weight and yet non-bending swing arm result in a very low inertia of the feed mechanism.

6 Claims, 4 Drawing Figures

Fig 3
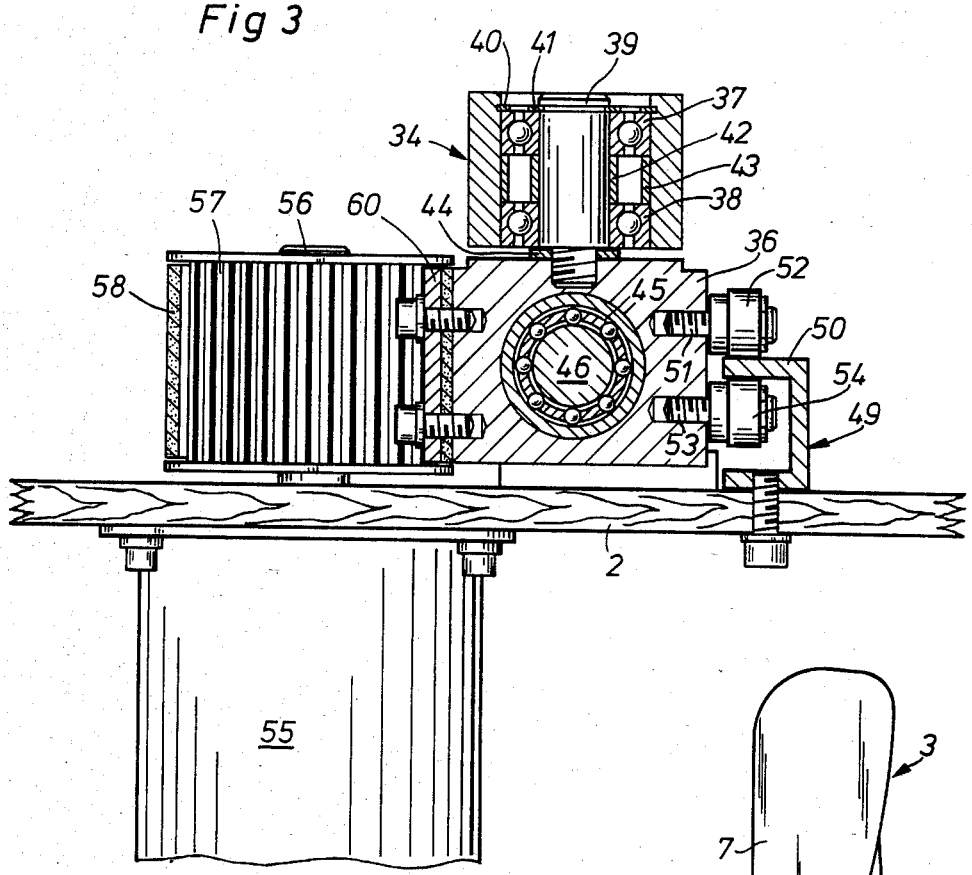
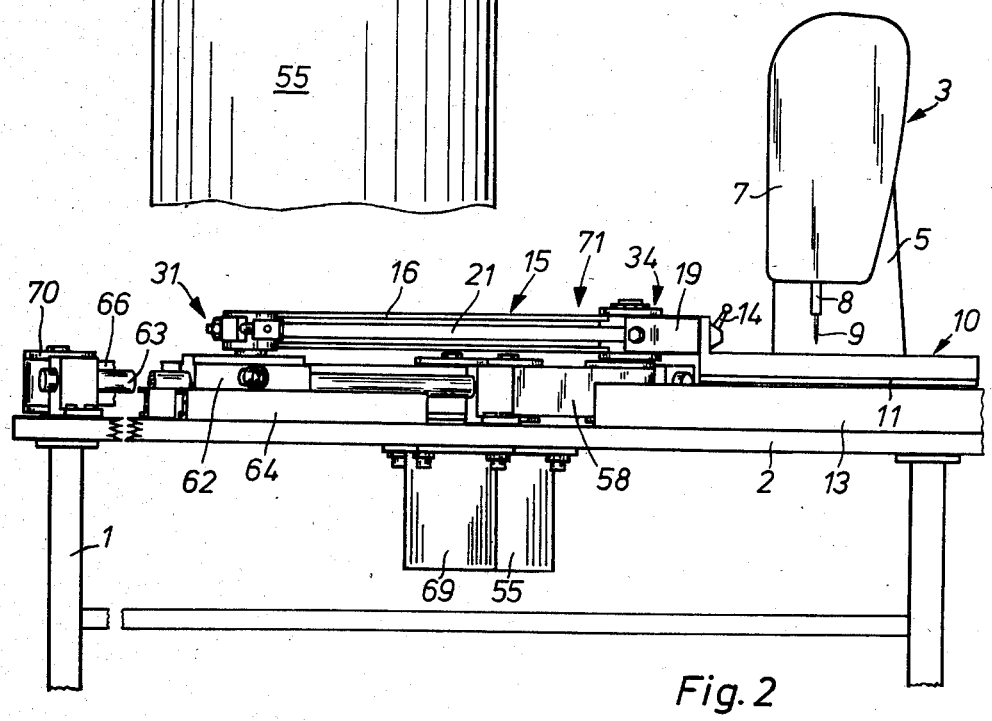
Fig. 2

SEWING MACHINE FEED MECHANISM

FIELD AND BACKGROUND OF THE INVENTION

This invention relates in general to sewing machines and in particular to a new and useful sewing machine feed mechanism which operates with very low inertia.

A sewing mechanism similar to the present invention is disclosed in U.S. Pat. No. 3,742,879. That prior art feed mechanism comprises two swing arms designated X and Y, which are mounted on fixed bolts and carry each a stepping motor as a positioning drive. The stepping motor secured to the Y arm drives through a pinion a geared rack which is mounted for displacement in the Y arm and hinged to the X arm. The stepping motor secured to the X arm drives, through the pinion, a geared rack which is mounted for displacement in the X arm and to which a work holder is secured. Even though the two-member drive linkage of this reference reduces the number of component parts to be moved, as compared to a prior art four member drive linkage, known for example from U.S. Pat. No. 3,983,845, inertia of this mechanism is still relatively too high since the stepping motors are secured to the swing arms and therefore are moved along with the arms.

A low inertia mechanism for driving a fabric clamp comprising a single sewing arm is known from U.S. Pat. No. 3,974,787. This is a telescopic structure where a slide is mounted in a swing carrier. Two stationary stepping motors drive the swing carrier and the slide by means of two ropes trained about rollers which are partly fixed and partly carried on the swing arm. The advantageous low inertia is outweighed by the disadvantage that this drive system is suitable only for small seam patterns, thus with a large radial displacement of the swing arm, a retracted swing arm produces small angular increments of the fabric clamp per step of the driving motor, while an extended swing arm causes large such increments. A relatively expensive stepping motor system would therefore be needed for driving the swing carrier, to obtain a highly accurate and fast feed, namely a system with small steps and a large stepping frequency.

Among other drawbacks, the ropes may become permanently extended, for example due to the material fatigue with the result of transmitting the motor steps inaccurately, or the drive system may oscillate at certain frequencies because of the shock absorbing springs provided between the machine frame and the stepping motors.

SUMMARY OF THE INVENTION

The present invention is directed to a low inertia feed device which is simple in construction and always accurately executes the control instructions supplied to the positioning motors, irrespective of whether the sewing pattern is small or large.

The two-member design of the linkage, mounting of the swing arm on slides which are driven by stationary positioning motors, and a slip-free positive drive connection between the motors and the slides, result not only in a low inertia of the system but also in a high accuracy in transmission of the movements to the work holder. The positive connection may be effected by a cog belt, geared rack, or screw spindle drive. Electrical or hydraulic stepping motors, or position controlled DC drives may be employed as the positioning motors.

Since the feed movements of the work holder are affected by shifting a slide and thus displacing the pivotal axes of the swing arms and, consequently, the length of the swing arms and spacing of the work holder from the pivotal axes do not vary, uniform steps of the positioning motors cause substantially constant displacements of the work clamp at any location of the sewing pattern. No modification of drive conditions need therefore be provided for small and large sewing patterns, or within large patterns. The inventive feed mechanism is universally usable for producing any sewing pattern.

With the design of the swing arm the spring steel strips are sufficiently prestressed to completely take up maximum bending loads introduced by the coupled swing arm, so that the center bar is subjected only to loads acting in the longitudinal direction thereof. It is therefore satisfactory to make the central bar resistant only to buckling. A non-buckling bar may be embodied simply by a low inertia hollow or I section of a light metal alloy. Since a sufficient prestressing may already be obtained with relatively thin and thus also light spring steel strips, the entire swing arm has a very small mass. The inertia of the feed mechanism is thus further reduced. Sufficiently prestressed spring steel strips make sure in addition that the swing arm cannot elastically bend under shocks. This still increases the accuracy transmission of the linkage.

The feature of a low inertia swing arm resistant to bending is not limited to feed mechanisms with two-member design of the linkage, it may advantageously be applied also to feed mechanisms of different design. To ensure an exactly equal prestressing of both of the steel spring strips, a clamping machanism may be associated with each of them.

In accordance with the invention, a sewing machine feed mechanism for a sewing machine having a needle which reciprocates over a support along which a workpiece is moved, comprises a work holder which is moved by two swing arms, each of which has one end which is pivotally mounted on a movable slide. One of the swing arms includes the transversely extending cross bar which is braced against a workpiece holder. The pivotal ends of each swing arm are moved along guide paths by stepping motors. The two swing arm members driven by the stationary motors results in a lightweight and unbending swing arm connection to the workpiece holder. One swing arm which is directly connected to the work holder includes a non-buckling center bar, a transverse bar at its end which is braced against the work holder and two prestressed spring steel strips which connect the ends of the cross bar to the swing arm adjacent its pivotal connection to the movable slides.

Accordingly, it is an object of the invention to provide an improved drive for a workpiece of a sewing machine in which a non-bending connection to the workpiece holder is effected with very low inertia of the feed mechanism.

A further object of the invention is to provide a feed mechanism which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

BRIEF DESCRIPTION OF THE DRAWINGS

In the drawings:

FIG. 2 is a front elevation of the sewing machine of FIG. 1;

FIG. 3 is an enlarged sectional view taken along the line III—III of FIG. 1.

DESCRIPTION OF THE PREFERRED EMBODIMENT

Figure 1:
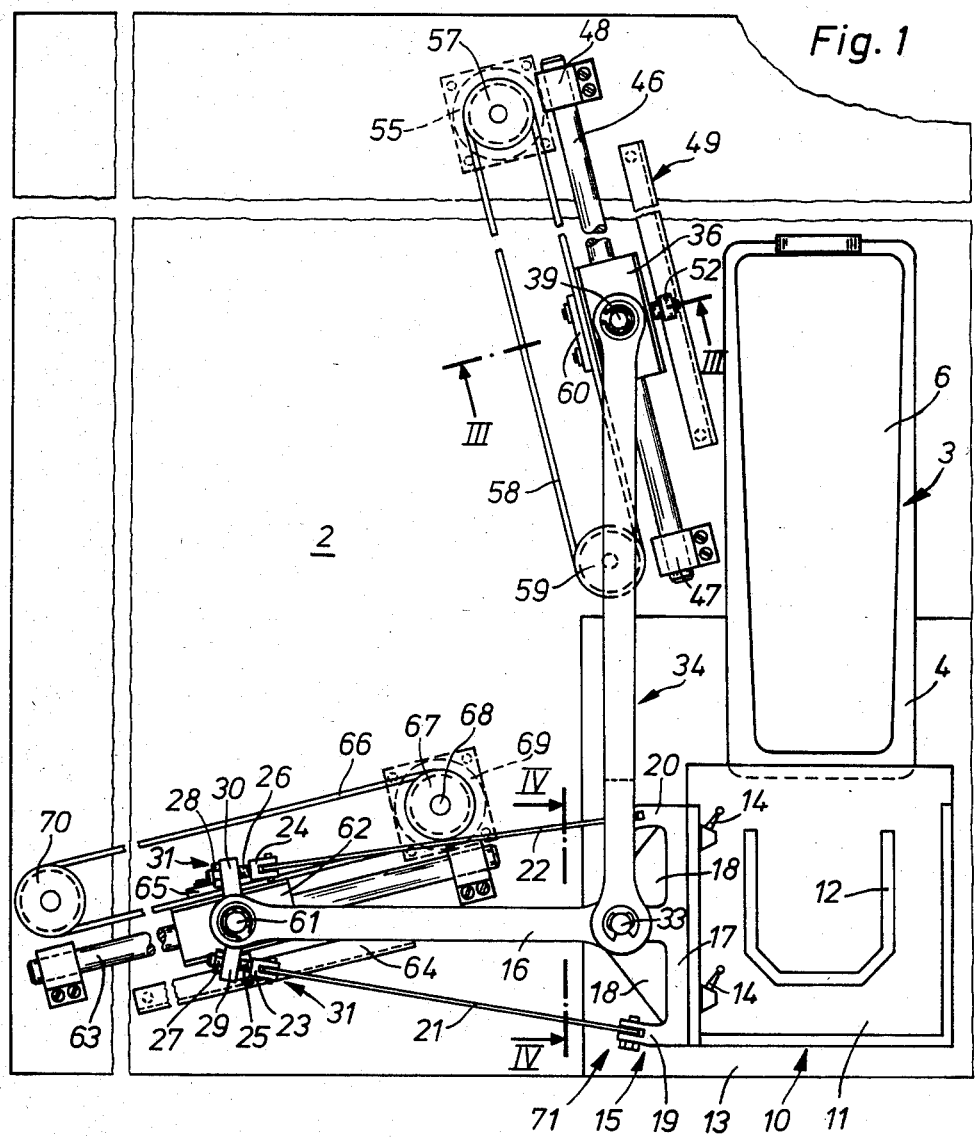
FIG. 1 is a top plan view of a sewing assembly constructed in accordance with the invention.

Referring to the drawings in particular the invention embodied therein comprises a feed mechanism for a sewing machine 3 having a needle 9 which reciprocates over a support for supporting plate 13 along which a workpiece is moved. The arrangement includes a work holder 10 which is moved by engagement of a cross member or cross bar 17 of a first swing arm assembly generally designated 15. The assembly 15 includes a first swing arm having a center arm portion 16 with a pivotal end pivotal on a pin 61 and an opposite end carrying the cross bar 17. The cross bar 17 extends outwardly from each side of the center arm 16. A second swing arm 34 has a first pivotal end pivotally mounted on a pin or bolt 39 and a second pivotal end opposite to the first end which is pivotally connected to the center arms 16 adjacent the end thereof which is connected to the cross bar 17. Means are provided for the control displacement of the pivotal end of each arm 16 and 34. This includes a first slide 62 pivotally supporting the pivotal end of the center arm 16 and a second slide 36 pivotally supporting a first pivotal end of the arm 34. The respective slides are moved along selected slide movement paths by stepping or positioning motors 55 and 69 respectively.

On a frame 1, a table plate 2 is supported to which a sewing machine 3 is secured. The sewing machine comprises a base plate 4, a post 5, and an arm 6 terminating with a head 7. Within head 7 a needle bar 8 is mounted in a manner known per se, carrying a needle 9.

The work to be sewed is clamped in a work holder 10 comprising a plate 11 for frictionally engaging the work, in which an aperture 12 having a shape corresponding to the seam to be produced is provided permitting the needle 9 to pass therethrough. Plate 11 is supported on a supporting plate 13 having a common upper level with base plate 4 of the sewing machine.

By means of tommy screws 14, work holder 10 is detachably connected to a swing arm 15 comprising a non-buckling center bar 16 having an I section (FIG. 4), and a cross bar 17 which is braced against center bar 16 by two gussets 18 and has two forked end extensions 19, 20. To each of these extensions, a spring steel strip 21, 22 is secured by its end. By its other end, each of these strips 21, 22 is secured to a clamping mechanism 31. Clamping mechanism 31 comprises a fork head 23, 24 with a threaded neck 25, 26 and an adjusting nut 27, 28.

The threaded necks 25, 26 are passed through extensions 29, 30 of center bar 16. Center bar 16 and cross bar 17 are made of a light metal alloy. Since spring steel strips 21, 22 can be made relatively thin, the inertia of the swing arm assembly 15 is low.

Figure 4:
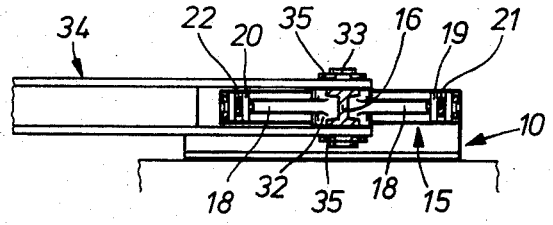
FIG. 4 is a sectional view taken along the line IV—IV of FIG. 1.

Center bar 16 is provided with an eye 32 (FIG. 4) in which a hinge bolt 33 is received. By means of bolt 33, the forked end forming two eyes of a swing arm 34 is hinged to center bar 16. Swing arm 34 also has an I section and is made of a light metal alloy. Bolt 33 is secured axially by two lock washers 34 (FIG. 4).

The other end of swing arm 34 is hinged to a slide 36. As shown in FIG. 3, this hinge connection comprises a bolt 39 which is secured to slide 36. Two ball bearings 37, 38 held axially by two lock washers 40, 41, two spacers 42, 43, and a plain washer 44. By means of a ball guide 45, slide 36 is displaceable on a slide rod 46 having its ends fixed in two clamps 47, 48 which are secured to table plate. Parallel to slide rod 46, a channel section guide rail 49 is secured to table plate 2 by one its leg portion. The other leg portion designated 50, of guide rail 49 forms two running surfaces for rollers 52, 54 which are carried on threaded bolts 51, 53 secured to slide 36, and are applied against portion 50 from above and below, respectively.

To the underside of table plate 2, a stepping motor 55 is secured. The shaft 56 of motor 55 is passed through table plate 2 and carries a cog wheel or gear 57 for a cog belt or gear belt 58. Belt 58 is further trained about a tail wheel 59, with the belt sections between wheels 57 and 59 extending parallel to slide rod 46. Cog belt 48 is firmly connected to slide 36 through a conformable pressure plate 60.

The other end of swing arm 15, opposite to hinge bolt 33, is hinged to a bolt 61 which is secured to a slide 62. This hinge connection is identical with that between swing arm 34 and slide 36 through bolt 39. Also identical is the mounting of slide 62 for displacement on a slide rod 63. Further, through two rollers (not shown), slide 62 applies against a guide rail 64 extending parallel to slide rod 63. Through a conformable pressure plate 65, slide 62 is connected to a cog belt 66. The belt is trained about a cog wheel 67 carried on the shaft 68 of a stepping motor 69 which is secured to the underside of table plate 2 and about a tail wheel 70 mounted for rotation on plate 2.

Stepping motors 55, 69, slides 36, 62 and swing arms 15, 34 form together with work holder 10 a feed mechanism 71.

The sewing assembly operates as follows:

The assembly is intended for sewing pockets on trousers for example, and forms a part of a larger operating unit comprising also a doubling station (not shown). At the doubling station, the pocket edges are folded in a manner known per se, and then the pocket is put in place on the trousers. Thereupon, work holder 10 detached from swing arm 15 is placed against the pocket and the trousers in such a position that aperture 12 coincides with the area of the seam. Next, work holder 10, now frictionally engaging the trousers and the pocket, is moved on supporting plate 13 to reestablish its connection with swing arm 15. Since the detachable connection between work holder 10 and swing arm 15 is not included in the subject matter of the present invention, this connection is indicated, for clarity, in a very simplified manner by tommy screws 14 to be actuated manually.

After work holder 10 has been connected to swing arm 15, the working cycle of the sewing assembly is started. With the sewing machine 3 initially at standstill, work holder 10 is moved from its rest position shown in FIG. 1 into its sewing position, by a program controlled action of stepping motors 55, 69 executing a corresponding number of drive steps. The control of stepping motors 55, 69 may be effected through a microcomputer (not shown) by which the number of drive pulses necessary for each of the motors is computed from position data recalled from a storage. Stepping motors 55, 69 drive cog belts 58, 66 by which slides 35, 62 are displaced on slide rods 46, 63. The motion of slides 36, 62 is transmitted to the respective swing arms 15, 34, whereby work holder 10 is displaced on supporting plate 13 relative to sewing machine 3 in accordance with the program, until the location at which the seam is to start is vertically aligned with needle 9. Then the sewing machine 3 is started and the desired seam is produced, with the stepping motors 55, 69 being controlled by the program.

While being displaced from its rest position to its sewing position, work holder 10 can be moved substantially continuously. During the sewing operation, however, it is moved only when needle 9 is not engaged in the work, so that it moves intermittently. The jerky stepwise movements thus transmitted from swing arm 34 to swing arm 15 act on the latter as bending loads with the maximum bending moment appearing in the area of hinge bolt 33. By correspondingly adjusting the two clamping mechanisms 31, the tension in spring steel strips 21, 22 is adjusted to amounts such that the maximum bending loads introduced by swing arm 34 are entirely taken up by strips 21, 22, and center bar 16 is exposed only to normal forces acting in the longitudinal direction thereof. Therefore, swing arm 15 cannot be elastically bent by the intermittent drive movements of swing arm 34.

The non-bending construction of swing arm 15 and the low inertia of the entire feed mechanism, as well as the slip-free drive connections between stepping motors 55, 69 and slides 36, 62 result in a highly accurate transmission of the movements produced by motors 55, 69 to work holder 10.

While a specific embodiment of the invention has been shown and described in detail to illustrate the application of the principles of the invention, it will be understood that the invention may be embodied otherwise without departing from such principles.

I claim:

1. A feed mechanism for a sewing machine having a needle reciprocating over a support along which a workpiece is moved, comprising a work holder, a first swing arm having a center arm with a pivotal end and an opposite end, a transversely extending cross bar extending outwardly from each side of said opposite end and engageable with said work holder, a second swing arm having a first pivotal end and a second pivotal end opposite to said first pivotal end connected to said center arm adjacent said center arm opposite end, a first slide pivotally supporting said pivotal end of said first swing arm, a second slide pivotally supporting said first pivotal end of said second swing arm, a spring strip extending between respective ends of said cross bar and the end of said center arm adjacent said pivotal end, and means for moving said first and second slides including a respective fixed stepping motor for each slide.

2. A feed mechanism according to claim 1, wherein each of said stepping motors includes a driving pulley, an endless member engaged with said pulley and connected to said slide for moving said slide in response to rotation of said pulley and guide means for guiding said endless member.

3. A feed mechanism according to claim 2, including a slide rod over which each of said slides is movable, and a slide guide alongside said rod, said slide having roller means engaged with said slide guide.

4. A sewing assembly of a sewing machine and a feed mechanism, comprising a work holder, first and second swing arms mounted for pivotal swinging movement, said swinging arms being hinged together, a positioning motor drivingly connected to each of said swing arms and being mounted at fixed separate locations a slide pivotally carrying each of said swing arms positively connected to and driven by a respective one of said motors, and a work holder carried directly by one of said swing arms.

5. A sewing assembly according to claim 4, wherein said swing arm carrying the work holder comprises a non-buckling center arm having one end forming a pivoted end and an opposite end, a cross bar connected to said opposite end of said swing arm connected to said work holder, said cross bar having respective ends extending to each side of said swing arm, and a separate prestressed spring steel strip connected to said respective ends of said cross bar and to the pivotal end of said swing arm.

6. A sewing assembly according to claim 5, including clamping means carried by said swing arm for adjusting the tension of said steel strips.

* * * * *